United States Patent [19]

Koizumi et al.

[11] Patent Number: 4,527,921

[45] Date of Patent: Jul. 9, 1985

[54] PAPER FEED APPARATUS FOR SHUTTLE PRINTER

[75] Inventors: Michio Koizumi; Yasuo Iwata; Seiichi Ohsawa, all of Saitama, Japan

[73] Assignee: Citizen Watch Co., Ltd., Tokyo, Japan

[21] Appl. No.: 653,682

[22] Filed: Sep. 21, 1984

[30] Foreign Application Priority Data

Sep. 30, 1983 [JP] Japan ..... 58-183852

[51] Int. Cl.[3] ..... B41J 15/16

[52] U.S. Cl. ..... 400/618; 400/649; 226/195

[58] Field of Search ..... 400/618, 649, 652, 653; 242/147 R, 75.2; 226/195

[56] References Cited

U.S. PATENT DOCUMENTS

| | | | |
|---|---|---|---|
| 1,063,815 | 6/1913 | McLaughlin | 400/653 |
| 3,586,149 | 6/1971 | Miller | 400/618 |
| 3,799,314 | 3/1974 | Smith | 400/618 |
| 4,019,619 | 4/1977 | Emenaker | 400/653 X |

FOREIGN PATENT DOCUMENTS

| | | | |
|---|---|---|---|
| 133985 | 10/1980 | Japan | 400/618 |
| 2077238 | 12/1981 | United Kingdom | 226/195 |

*Primary Examiner*—Edgar S. Burr
*Assistant Examiner*—Charles A. Pearson
*Attorney, Agent, or Firm*—Koda and Androlia

[57] ABSTRACT

A paper feeding apparatus used in shuttle printers including drive means for moving a print sheet and a paper holding spring for holding the print sheet on a platen to apply a back-tension to the print sheet when it is being moved. The feeding apparatus further includes friction means disposed opposed to the print sheet at a position forward of the platen in the direction of feeding, pressure spring means located opposed to the friction means, and a lever for biasing the pressure spring means against the friction means. The platen is movable between a first position where it is engaged by the paper holding spring and a second position where the plate is disengaged by the paper holding spring. The biasing lever has its tip placed in non-contact with the platen when the platen is engaged by the paper holding spring, whereby the lever can be engaged by the platen to separate the pressure spring means from the print sheet when the platen is moved from the first position to the second position.

2 Claims, 6 Drawing Figures

PAPER FEED APPARATUS FOR SHUTTLE PRINTER

BACKGROUND OF THE INVENTION

1. Field of the Invention

The present invention relates to a paper feed apparatus for a shuttle printer and particularly to such a paper feed apparatus comprising a platen and second paper holding means located forwardly of the platen.

2. Description of the Prior Art

There is well known a dot printer in which printing styluses are driven against a sheet of paper to be printed in accordance with information of printing to form letters, symbols or others with plural dots. Such a dot printer has been utilized as an output device in various information instruments. There is also well known a dot-line printer derived from the above dot printer, in which a plurality of printing styluses are arranged at regular space intervals on a single line corresponding to one line of the sheet and reciprocated by wire pitches to effect the desired printing while feeding the sheet in the direction perpendicular to the direction of feed. The dot-line printer is advantageous in that printing can be carried out at extremely high speeds. Since the pivotable part on which said plurality of printing styluses are mounted in line and which is reciprocated between wire pitches is called a shuttle, the above type dot-line printer is known as a shuttle printer.

In such a shuttle printer, a print sheet must be fed on each of dot-line printings. To increase the quality of printed letters, one requires a paper feed system which is operable to accurately feed print sheets.

FIG. 1 shows the primary components of a paper feed apparatus for use in the prior art shuttle printer. Print sheets 10 are housed within the printer and each drawn along a guide plate 12 into paper feeding drive means 16 through a platen 14, the drive means including a paper feeding tractor. The print sheet 10 is moved to a printing station by the drive means 16. During the movement of the print sheet 10, it is held against the platen 14 by means of a paper holding spring 18 to provide a back-tension to the print sheet 10.

Opposed to the platen 14 is arranged shuttle 22 which reciprocally travels in a horizontal direction along the print sheet 10, holding a plurality of printing styluses 20 therein. The shuttle 22 can be oscillated a predetermined stroke by the drive of shuttle driving means 24, whereat the printing stylus 20 is impacted against the print sheet 10 to form the desired dot-letter or symbol thereon.

However, such a printer is disadvantageous in that the print sheet 10 is slacked when the printing operation is once stopped. The slacking decreases the quality of printed letters when the printing operation is re-started.

More particularly, the shuttle 22 cannot rapidly be stopped on receipt of the instruction and oscillates for only a slight time until its motion is completed. When another instruction is provided to the printer, the oscillation of the shuttle 22 is re-initiated and continued until the speed thereof reaches a predetermined value only at which the printing stylus 20 is impacted against the print sheet 10 to form a dot-letter thereon.

At this time, as previously described, the back-tension is exerted to the print sheet 10 primarily by the fact that it is pressed against the platen 14 by the sheet holding spring 18. Therefore, due to vibration created by the oscillation of the shuttle 22 when the printing operation is stopped and then re-started, the biasing force of the spring 18 will be reduced to provide a slack in the print sheet 10.

If the printing operation is re-initiated when the print sheet 10 has such a slack, initially printed dots are overlapped by later printed dots, as shown in FIG. 2.

More particularly, when the print sheet 10 is to be moved through a predetermined distance after initial dots have been printed thereon, the movement of the print sheet 10 is used to accommodate the slack thereon between the platen 14 and the paper feeding drive means 16 so that the portion of the print sheet 10 engaging the platen 14 will not substantially be fed. As a result, new dots will be printed overlapping with the first printed dots until the slack on the sheet 10 is completely taken up.

SUMMARY OF THE INVENTION

It is therefore an object of the present invention to provide a paper feeding apparatus for use in the shuttle printer, which can positively feed print sheets to prevent reduction of quality in letters printed thereon even when the printing operation is re-started.

To accomplish the above object, the present invention provides a paper feed apparatus for use in the shuttle printer, which comprises means for driving a print sheet and a paper holding spring for holding the print sheet against a platen to apply a back-tension to the print sheet as the latter is being moved, said apparatus being characterized by friction means located opposed to the print sheet at a position short of said platen in the direction of feed, pressure spring means disposed opposed to said friction means and a lever for biasing said pressure spring means against said friction means, said platen being movable between a position in which said platen is engaged by said holding spring and a position in which said platen is disengaged by said holding spring, said biasing lever being so located that said lever is in non-contact with said platen when the tip of said biasing lever is engaged by said holding spring, whereby said lever can engage said platen to separate said pressure spring means from the print sheet when said platen is disengaged by said holding spring.

DETAILED DESCRIPTION OF THE INVENTION

Figure 1:
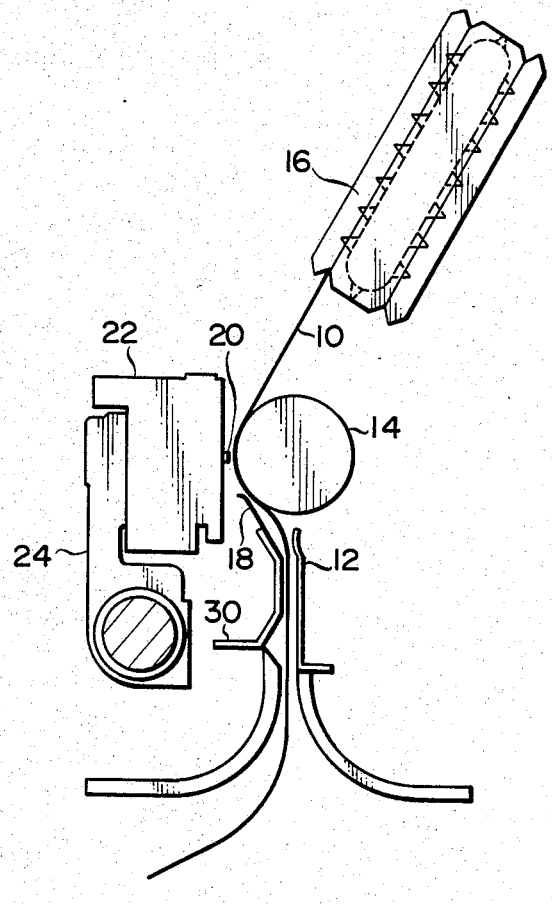
FIG. 1 is a schematic view showing the primary parts of the prior art paper feeding system for use in the shuttle printer.
Figure 2:
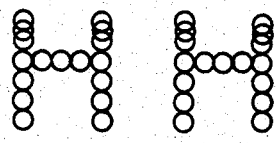
FIG. 2 illustrates the form of letters dot-printed by the system of FIG. 1 on re-start of the printing operation.
Figure 3:
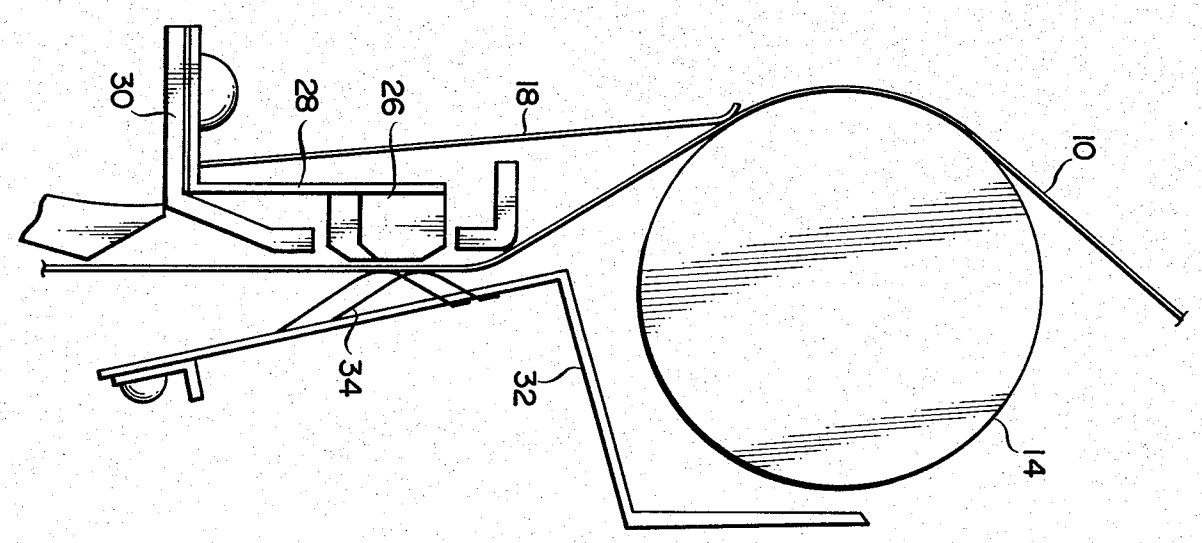
FIG. 3 is a schematic view showing the primary parts of a paper feeding apparatus constructed according to the present invention.

Referring to FIG. 3, there is shown a paper feed apparatus according to the present invention, which is used in the shuttle printer and in which parts similar to those of the prior art system are denoted by similar reference numerals and not further described herein.

The present invention is characterized by that in addition to first back-tension applying means in the form of a paper holding spring, there is provided second back-tension applying means for applying a steady back-tension to the print sheet such that the quality of printed letters will positively be prevented from reducing on restart of the printing operation.

In the illustrated embodiment, a friction plate 26 is disposed forwardly of the platen 14 in the direction of feed. The friction plate 26 is firmly mounted on a holding frame 30 through an arm 28 with the friction face thereof being faced to the print sheet 10.

On the other hand, a lever 32 is located in the side of the print sheet 10 opposite to the friction plate 26. On the lever 32 is mounted a pressure spring 34 for pressing the print sheet 10 against the friction plate 26, this pressure spring being in the form of a leaf spring in the illustrated embodiment. In the normal printing operation, the lever 32 is biased against the friction plate 26 by biasing means (not shown) so that the print sheet 10 is pressed against the friction plate 26 under the action of the pressure spring 34.

Although the tip of the lever 32 is engaged by the platen in the illustrated position, it is placed into non-contact with the platen 14 in the normal position, that is, when the print sheet 10 is pressed against the friction plate 26 by the action of the pressure spring 34.

Figure 4:
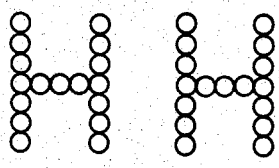
FIG. 4 illustrates the form of letters printed by a shuttle printer incorporating the paper feeding apparatus according to the present invention on re-start of the printing operation.

In such an arrangement, the print sheet 10 is pressed against the friction plate 26 by the pressure spring 34 when the printing operation is restarted or when the steady printing operation is continued. Consequently, if the shuttle is oscillated to create a vibration when the printing operation is stopped or restarted, no slack will be produced in the print sheet 10. Thus, the print sheet 10 cna exactly be moved through a predetermined distance by the paper feeding drive means 16 so that overlapped dots will not be printed on the print sheet 10 by the printing styluses 20 when the printing operation is restarted. This provides such favorable printed letters as shown in FIG. 4.

In the illustrated embodiment, the print sheet 10 may be in the form of rolled or folded sheet which is housed within the printer.

Figure 5:
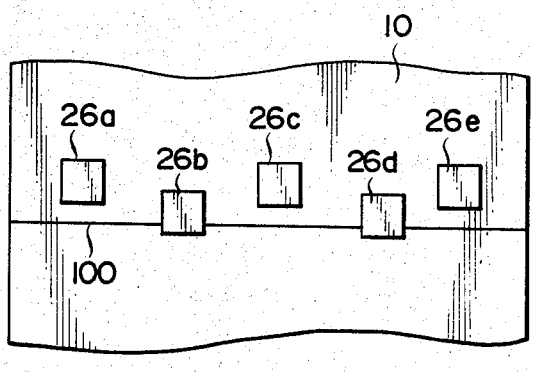
FIG. 5 illustrates two rows of friction plates in the present invention.

If the print sheet 10 is folded in the printer, it is possible that each of the folding lines in the print sheet 10 varies the back-tension therein. To overcome such a problem, a plurality of friction plates **26*a*–26*e* may be arranged in two rows or a zig-zaged line in the direction perpendicular to the direction of feed, as shown in FIG. 5. Since these friction plates 26*a*–26*e* simultaneously hold the print sheet 10, the folding line 100 in the sheet 10 is leveled as the sheet 10** is being moved, so that the change in back-tension can be avoided to provide printed letters increased in quality.

Figure 6:
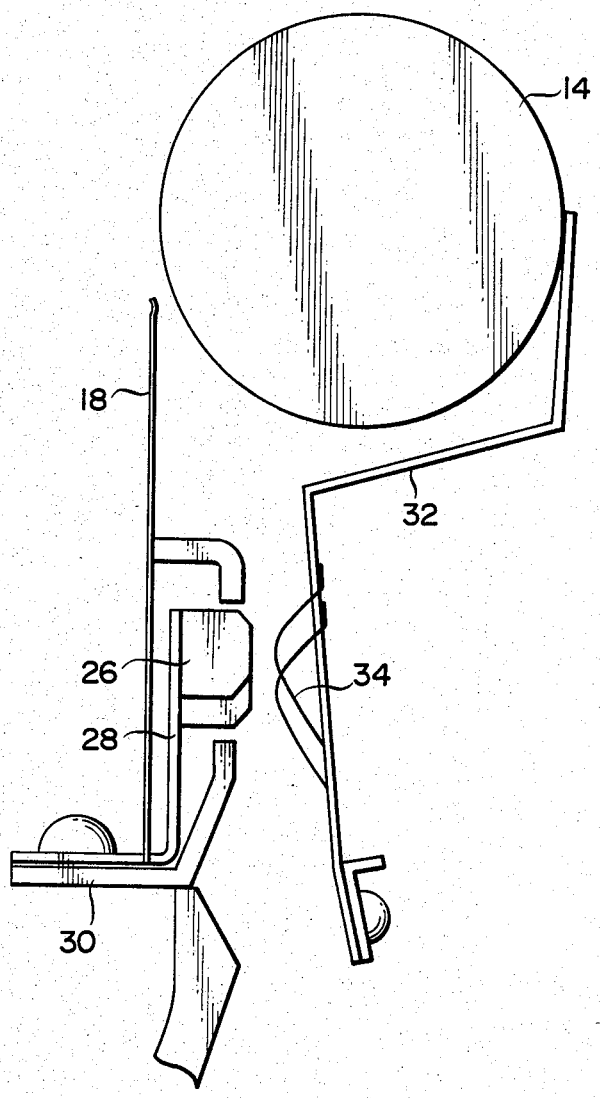
FIG. 6 illustrates the position of a lever in the apparatus according to the present invention when the print sheet is resupplied into the shuttle printer.

In the illustrated embodiment, the platen 14 is movable between a first position in which it is engaged by the paper holding spring 18 as shown in FIG. 3 and a second position in which the platen 14 is disengaged by the paper holding spring 18 as shown in FIG. 6. When it is wanted to re-supply a new print sheet, the platen 14 is moved from the first position to the second position. As a result, the lever 32 is then engaged by the platen 14 to separate the pressure spring 34 from the friction plate 26. There is thus created a gap between the friction plate 26 and the pressure spring 34 through which the print sheet 10 can easily be charged into the printer.

We claim:

1. A paper feeding apparatus for use in a shuttle printer, comprising paper feeding drive means for feeding a print sheet and a paper holding spring for holding the print sheet on a platen to apply a back-tension to the print sheet as it is being moved, said apparatus being characterized by friction means disposed opposed to the print sheet at a position forwardly of said platen in the direction of feed, pressure spring means located opposed to said friction means, and a lever for biasing said pressure spring means against said friction means, said platen being movable between a first position in which the platen is engaged by said paper holding spring and a second position in which the platen is dis-engaged by said paper holding spring, said biasing lever having its tip placed in non-contact with said platen when the platen is engaged by said paper holding spring, said leverengaging said platen to separate said pressure spring means from the print sheet when the platen is moved from said first position to said second position.

2. A paper feeding apparatus as defined in claim 1, wherein said friction means includes a plurality of friction plates arranged in a zig-zag pattern in the direction perpendicular to the direction of feed and wherein said pressure spring means includes the corresponding number of pressure springs arranged opposed to the respective friction plates.

* * * * *